US007708142B2

(12) United States Patent
Ehrlund

(10) Patent No.: US 7,708,142 B2
(45) Date of Patent: May 4, 2010

(54) CHILD RESISTANT PACKAGING WITH SLIDABLE TRAY SECTION

(75) Inventor: Åke Ehrlund, Spånga (SE)

(73) Assignee: Stora Enso Activation AB, Stockholm (SE)

( * ) Notice: Subject to any disclaimer, the term of this patent is extended or adjusted under 35 U.S.C. 154(b) by 718 days.

(21) Appl. No.: 10/576,820

(22) PCT Filed: Sep. 6, 2002

(86) PCT No.: PCT/SE02/01600

§ 371 (c)(1),
(2), (4) Date: Nov. 16, 2006

(87) PCT Pub. No.: WO03/101840

PCT Pub. Date: Dec. 11, 2003

(65) Prior Publication Data

US 2007/0181458 A1 Aug. 9, 2007

(30) Foreign Application Priority Data

May 30, 2002 (SE) ..... 0201610

(51) Int. Cl.
*B65D 85/42* (2006.01)
*A45C 13/10* (2006.01)

(52) U.S. Cl. ..... 206/528; 206/1.5

(58) Field of Classification Search ..... 206/1.5, 206/267, 528–540, 387.12; 229/125.125, 229/125.12, 5.84; 220/345.1, 345.4, 259.5
See application file for complete search history.

(56) References Cited

U.S. PATENT DOCUMENTS 3,186,542 A * 6/1965 Greene ..... 206/449
3,416,648 A * 12/1968 Levi ..... 206/141
3,888,350 A 6/1975 Horvath
4,076,117 A * 2/1978 Wisdom et al. ..... 206/106
4,120,400 A 10/1978 Kotyuk
4,401,210 A 8/1983 Anjou
4,534,463 A * 8/1985 Bouchard ..... 206/267

(Continued)

FOREIGN PATENT DOCUMENTS

EP 1002744 A1 5/2000

(Continued)

*Primary Examiner*—J. Gregory Pickett
(74) *Attorney, Agent, or Firm*—Albihns.Zacco AB

(57) ABSTRACT

A package is proposed, comprising a sleeve (2) of essentially parallelepipedal shape, and an insert ((3) which can be inserted into and withdrawn from the sleeve (2) in a sliding direction (S) through an opening (4) in the sleeve (2), the sleeve (2) comprising four longitudinal walls (2*a*, 2*c*) which are essentially parallel to the sliding direction (S). The package is characterized in that the sleeve is provided with a first stop tab (7) which extends from a first (2*c*) to a second (2*a*) of the longitudinal walls, the tab being at least partly separated from the first longitudinal wall (2*c*) and the second longitudinal wall (2*a*) in that the insert has a first locking edge (9*a*), the insert being prevented, upon contact of the first locking edge with the first stop tab (7*a*), from moving out of the sleeve, and in that the first locking edge (9*a*) can, by elastic deformation of a part of the insert (3) by means of maneuvering by a user, be moved so that its movement past the first stop tab (7*a*) is made possible.

5 Claims, 6 Drawing Sheets

U.S. PATENT DOCUMENTS

| | | | | |
|---|---|---|---|---|
| 4,561,544 | A | 12/1985 | Reeve | |
| 5,080,222 | A | 1/1992 | McNary | |
| 5,421,452 | A * | 6/1995 | Hybiske | 206/312 |
| 6,168,073 | B1 | 1/2001 | Towle | |
| 7,389,875 | B2 * | 6/2008 | Sandberg et al. | 206/531 |
| 2004/0099565 | A1 * | 5/2004 | Dehlin et al. | 206/536 |

FOREIGN PATENT DOCUMENTS

| | | | |
|---|---|---|---|
| GB | 1494313 | A | 12/1977 |
| GB | 2042476 | A * | 9/1980 |
| WO | WO 0238454 | A1 | 5/2002 |

* cited by examiner

CHILD RESISTANT PACKAGING WITH SLIDABLE TRAY SECTION

TECHNICAL FIELD

The present invention relates to a package comprising a sleeve of essentially parallelepipedal shape, and an insert which can be inserted into and withdrawn from the sleeve in a sliding direction through an opening in the sleeve, the sleeve comprising four longitudinal walls which are essentially parallel to the sliding direction.

BACKGROUND

In packages with dangerous contents, especially pharmaceutical preparation packages, it is desirable to prevent small children who happen to have gained access to the package gaining access to its contents. In the packaging field, various solutions have been proposed for solving this problem.

EP 1 002 744 A1 describes a cardboard package with a locking system for children, with an outer casing and an inner sliding part. The sliding part is prevented from being drawn out of the casing unless a locking system has been inactivated by pressing on a release button. The locking system functions by virtue of a tab on the sliding part coming into contact with a shoulder on the inside of the casing. The shoulder is formed by virtue of an inner cardboard ply, glued to an outer ply, being provided with a cutout. A disadvantage of this construction is that, for the locking system to function, it relies on the shoulder having sufficient height by virtue of the thickness of the inner cardboard ply. The locking function is thus made dependent on the selection of a sufficiently thick material for the casing. A material which is too thin can result in the locking security being put at risk. Moreover, it is likely that the construction will lead to the shoulder being worn down on repeated use, and that its function will be impaired after a number of openings of the package.

Patent document PCT/SE01/02496 describes a package with a locking arrangement for preventing small children opening the package and gaining access to its contents. The package comprises a sleeve into which an insert part can be inserted. The insert part is provided with a locking tab which, by contact with a stop tab designed on the inside of the sleeve; prevents the insert part being drawn out of the sleeve. In order to cause the stop tab to be located in the way of the locking tab in the drawing-out direction of the insert part, the stop tab is provided with a projecting part which, by bearing against one of the walls of the sleeve, causes the stop tab to be located at an angle to the wall so that it projects into the path of the locking tab. To draw out the insert, it is necessary for the user to manoeuvre the locking tab so that it is moved so that it is located outside the area of the stop tab in the drawing-out direction.

A problem with the solution in PCT/SE01/02496 is that the projecting part on the stop tab involves difficulties in the manufacture of the package. In the usual case of the sleeve being manufactured from a cardboard blank, the projecting part is produced by the blank being punched and stamped, a bowl-shaped portion being formed in the blank. This must take place before the sleeve is glued together. During gluing, the glued surfaces are pressed against one another in an automated process. In this regard, special consideration has to be given to the projecting part produced by punching, so that the latter is not flattened out. Both the stop tab and the glued surfaces are produced at the edge of the cardboard blank, which means that the stop tab is located in direct proximity to the glued surfaces. In this regard, the pressing-together stage in the gluing process is made even more difficult.

The package in PCT/SE01/02496 comprises a locking tab which is produced by folding the insert blank. In the inserted position of the insert part in the sleeve, the locking tab extends inside the package, essentially from the lower wall to the upper wall thereof. The locking tab is manoeuvred by means of a manoeuvring tab on the top side of the package, where the locking tab has a free end.

A problem of this solution is that, in the event that the package is designed so that it is relatively tall, that is to say the distance between the lower wall and the upper wall is great, the locking tab is long. It then has inferior strength because it has a great buckling length. There is then a great risk that, instead of being folded in the intended manner when manoeuvring takes place, the locking tab will be deformed by buckling. Another problem is that the locking tab is relatively bulky, which makes it necessary for the package to be made larger than its contents require.

A further problem with the design of the locking tab according to PCT/SE01/02496 is the following. The locking tab is arranged so as to extend from the bottom of the package through the same at an angle to its walls. The angle is required because manoeuvring of the locking tab takes place from the top side of the package and, when the locking tab is manoeuvred, it is pivoted about its attachment to the insert part so that the angle is changed. In the event that the package is designed so that it is relatively tall, the angle of the locking tab makes it necessary for the package to be sufficiently wide as well. This imposes limits on the design possibilities for the package. The problem is even more apparent in the event that two locking tabs are used in the manner proposed in PCT/SE01/02496. The locking tabs are then located side by side in the transverse direction of the package, and, when a tall package is to be produced, a great width is required in order to accommodate the two long angled locking tabs and afford them sufficient movement space.

SUMMARY

One object of the present invention is to produce a package which counteracts the access of children to its contents and which avoids the problems described above.

It is a particular object of the present invention to produce a package which counteracts the access of children to its contents and the manufacture of which is simplified in relation to the known art.

It is a particular object of the present invention to produce a package which counteracts the access of children to its contents and the gluing of which in the manufacture of the same is simplified in relation to the known art.

It is furthermore a particular object of the present invention to produce a package which counteracts the access of children to its contents, this counteractive function not being impaired in the event of repeated opening of the package.

It is moreover a particular object of the present invention to produce a package which counteracts the access of children to its contents, where great flexibility is provided with regard to design of the package without its function to counteract the access of children being impaired.

These objects are achieved by a package of the type referred to in the introduction, which is characterized in that the sleeve is provided with a first stop tab which extends from a first to a second of the longitudinal walls, the tab being at least partly separated from the first longitudinal wall and the second longitudinal wall, in that the insert has a first locking edge, the insert being prevented, upon contact of the first locking edge with the first stop tab, from moving out of the sleeve, and in that the first locking edge can, by elastic deformation of a part of the insert by means of manoeuvring by a user, be moved so that its movement past the first stop tab is made possible.

The stop tab arranged according to the invention results in it being located inside the sleeve walls in the sliding direction of the insert without a special projecting part having to be arranged on the stop tab in order for the latter to be located at a distance from the sleeve walls. As the requirement for a projecting part is therefore eliminated, manufacture of the sleeve can also be simplified.

A preferred embodiment of the invention is moreover characterized in that the longitudinal walls of the sleeve comprise an upper wall, a lower wall, a first side wall and a second side wall, in that the insert comprises a bottom part and a first side part, which, in the inserted state of the insert, are located essentially parallel to and next to the lower wall and the first side wall, respectively, of the sleeve, the first locking edge being formed on the first side part, in that the first longitudinal wall and the second longitudinal wall between which the first stop tab extends are the first side wall and the upper wall, respectively, in that the first side wall is provided with a first hole, through which said manoeuvring can take place, the elastic deformation taking place at least partly in the first side part so that at least a part thereof moves away from the first side wall. By virtue of the preferred embodiment, the means located on the insert and acting to bring about the locking function are designed on the side part of the insert so that a strong construction is obtained, in particular if the side part extends along a major part of the bottom part and is connected to the same along a major part of its length. The fact that the side part is, in the inserted state of the insert, located essentially parallel to and next to the first side wall of the sleeve means that the means located on the insert and acting to bring about the locking function do not take up an appreciably great amount of space in the package.

Another advantage of the preferred embodiment is that that side part of the insert with the means located on the insert and acting to bring about the locking function is oriented parallel to the side of the package, which means that the package can be constructed with tall side walls without consideration having to be given to its other dimensions.

The preferred embodiment of the invention is also characterized in that the sleeve is manufactured from a cardboard blank, in that the first side wall comprises at least parts of two cardboard portions of the cardboard blank, one cardboard portion, in the side wall, being located inside the other cardboard portion, in that the first hole is formed by an inner hole in the inner cardboard portion and an outer hole in the outer cardboard portion, and in that a pivotable flap is arranged on the inner cardboard portion, the flap in a closed position, in the plane of the first side wall, extending at least partly outside the area of extent of the outer hole. This means that the flap can, by means of finger pressure from the outside of the package, be pivoted inwards so that, by contact with the side part of the insert, it guides the latter away from the side wall. The solution according to the preferred embodiment furthermore means that the flap cannot be pivoted outwards because it is larger than the outer hole.

DESCRIPTION OF THE FIGURES

The invention will be described in detail below with reference to the drawings, in which.

DETAILED DESCRIPTION

Figure 1:
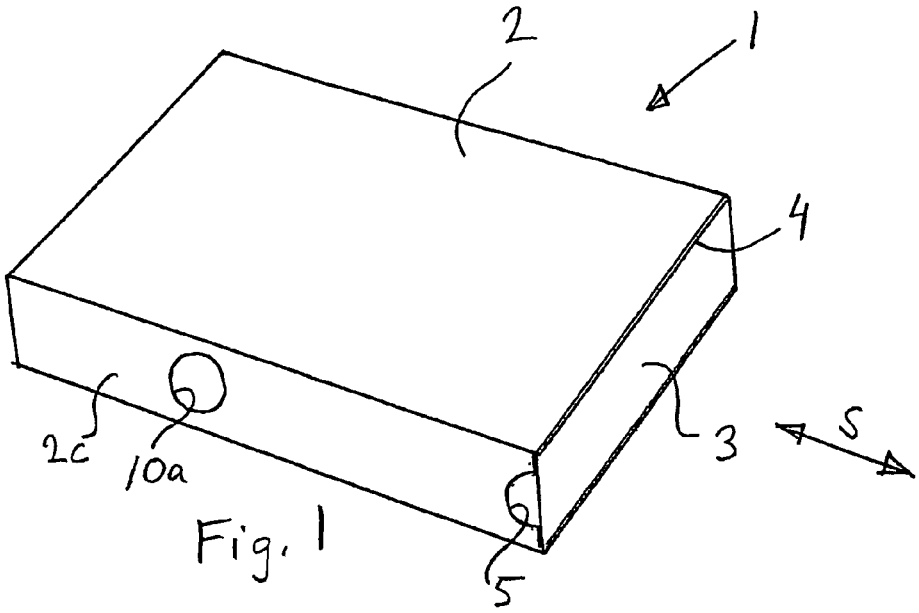
FIG. 1 shows a perspective view of a package according to a preferred embodiment of the invention.
Figure 2:
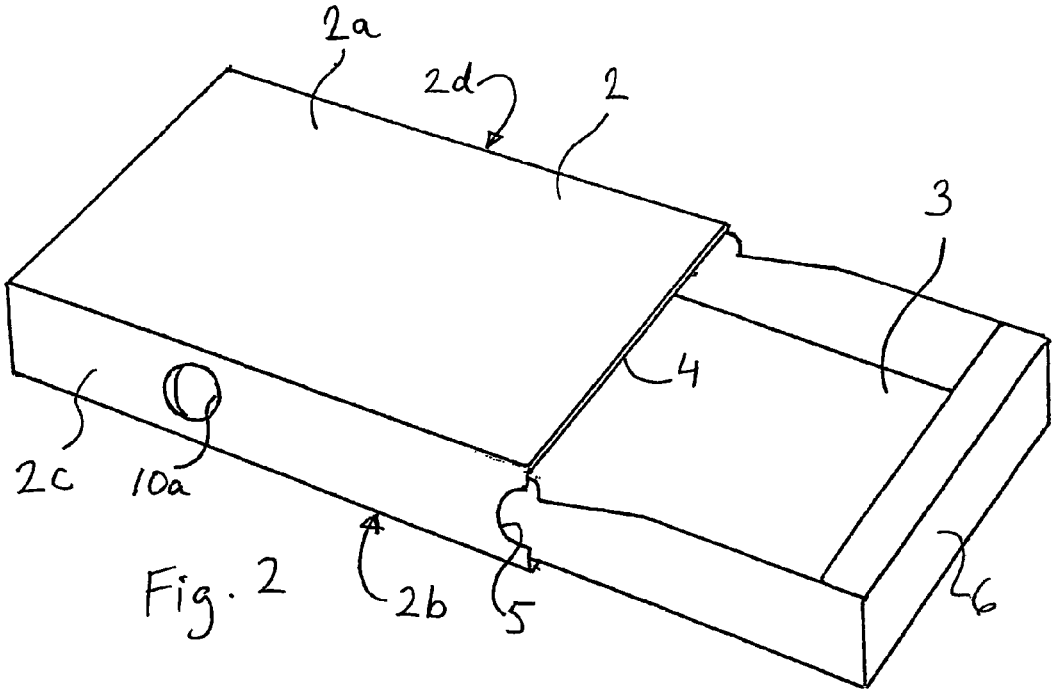
FIG. 2 shows another perspective view of the package in FIG. 1.

FIG. 1 shows a package 1 according to a preferred embodiment of the invention. The package comprises a sleeve 2 of essentially parallelepipedal shape, and an insert 3 intended to hold the contents of the package. The sleeve 2 and the insert 3 are preferably produced by folding and gluing blanks made of cardboard material (see below). The insert 3 can be inserted into and withdrawn from the sleeve 2 in a sliding direction S, indicated by a double arrow in FIG. 1, through an opening 4 in the sleeve 2. FIG. 1 shows the package 1 in the completely inserted state of the insert. FIG. 2 shows the package 1 in a partly withdrawn state of the insert 3, access to the contents of the package being possible.

The sleeve 2 comprises four longitudinal walls which are essentially parallel to the sliding direction S. The longitudinal walls are an upper wall 2*a*, a lower wall 2*b*, a first side wall 2*c* and a second side wall 2*d*, the upper wall 2*a* and the first side wall 2*c* being visible in FIGS. 1 and 2.

At the opening 4, the side walls 2*c*, 2*d* each have gripping notches 5, at each of which the insert 3 can be gripped by a finger in order to be drawn out. The width of the package is preferably adapted so that the insert 3 can be gripped only by people who have sufficiently large hands for this. This means that small children cannot reach across the width of the package with a thumb/forefinger grip in order to draw the insert 3 out.

At one end, the insert 3 preferably has a beam-like part 6 which is produced by folding an insert blank (see below). The beam has such stiffness that it is impossible or extremely difficult for a child to deform the end of the insert and in this way reach the contents of the package.

At the opening 4, the sleeve 2 preferably has two tabs which are folded inwards essentially parallel to the upper wall 2*a* and the lower wall 2*b*, respectively, (see below). This means that an upper and a lower edge at the opening 4 are reinforced, making it impossible or difficult for children to tear open the sleeve 2 at these edges in order to reach the contents of the package.

Figure 3:
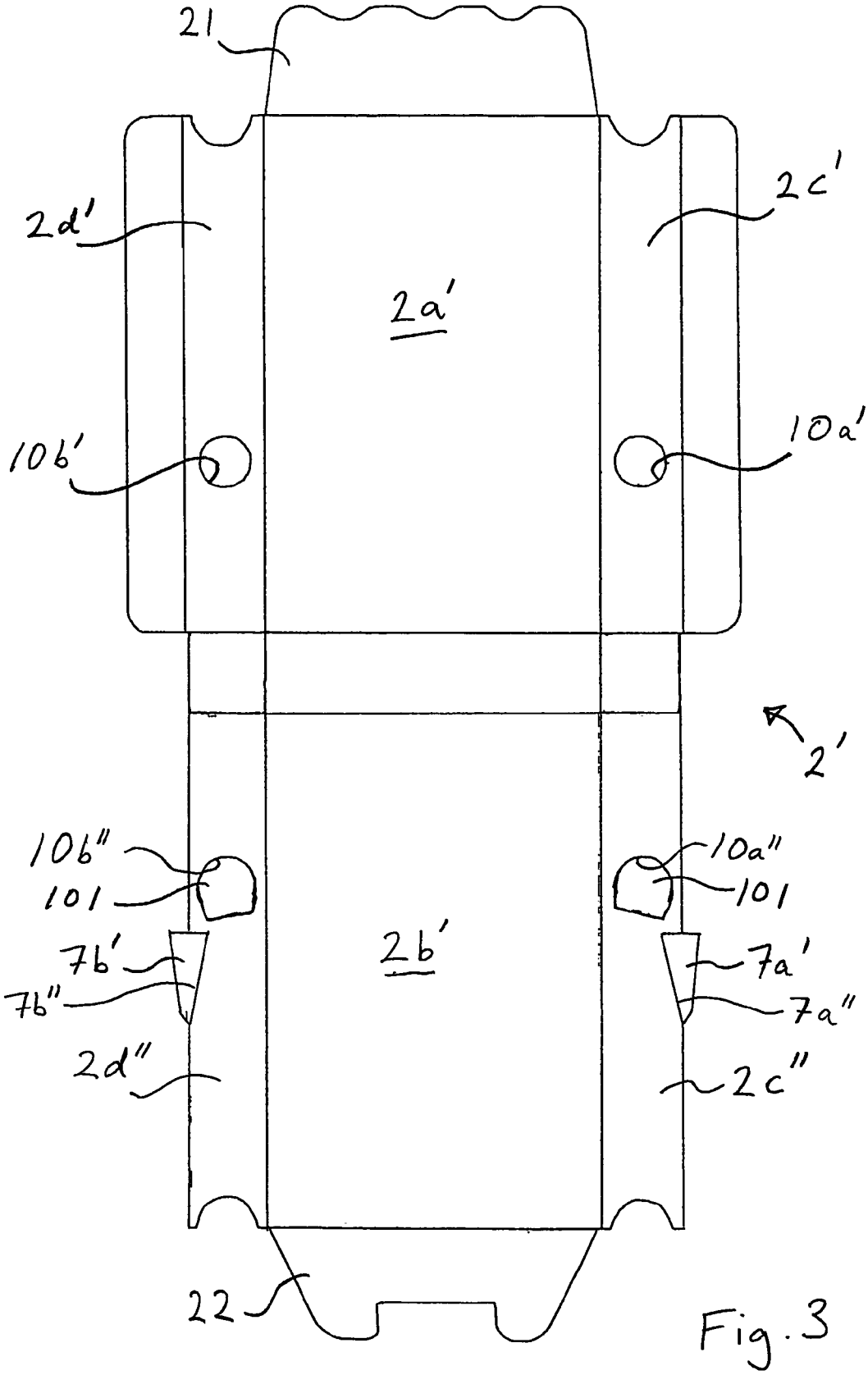
FIG. 3 shows a manufacturing blank for a part of the package in FIG. 1.

FIG. 3 shows a sleeve blank 2' made of cardboard, which is formed into the sleeve 2 by folding and gluing. As can be seen in FIG. 3, the sleeve blank 2' comprises the two tabs 21, 22 which, as mentioned above, reinforce the opening 4 of the sleeve by being folded inwards essentially parallel to the upper wall 2*a* and the lower wall 2*b*, respectively.

The sleeve blank 2' comprises a first portion 2*a'* intended to form the upper wall 2*a* of the sleeve and a second portion 2*b'* intended to form the lower wall 2*b* of the sleeve. A third portion 2*c'* and a fourth portion 2*c"* are intended to form the first side wall 2*c* of the sleeve, the fourth portion 2*c"* being intended to be positioned inside the third portion 2*c'*. In a corresponding way, a fifth portion 2*d'* and a sixth portion 2*d"* are intended to form the second side wall 2*d* of the sleeve.

A seventh portion 7*a'* and an eighth portion 7*b'* are intended to form a first stop tab 7*a* and a second stop tab 7*b*, respectively, which act to bring about locking of the insert 3 in the sleeve 2, which is described in greater detail below. As can be seen in FIG. 3, the portions 7*a'*, 7*b'* which are to form stop tabs have an essentially triangular shape, one of the points of the triangle being located at a free longitudinal edge on the fourth portion 2*c"* and the sixth portion 2*d"*, respectively. The seventh portion 7*a'* and the eighth portion 7*b'* project outside the free longitudinal edge on the fourth portion 2*c"* and the sixth portion 2*d"*, respectively, and they are intended to be folded at respective lines 7*a"*, 7*b"* inside said free edges.

Alternatively, the portions which are to form stop tabs can have a shape other than triangular, for example rectangular.

When the sleeve blank is folded, the fourth portion 2*c"* and the sixth portion 2*d"* are folded so that their free longitudinal edges are positioned at the connection between the upper wall 2*a* and the first side wall 2*c* and the second side wall 2*d*, respectively, of the sleeve. The seventh portion 7*a'* and the eighth portion 7*b'* are then folded so that they are positioned at an angle to the upper wall 2*a* and the first side wall 2*c* and the second side wall 2*d*, respectively, of the sleeve; they then form the first stop tab 7*a* and, respectively, the second stop tab 7*b*. Each stop tab is therefore connected to the respective side wall and forms an angle in relation to the same by bearing against the upper wall.

Figure 4:
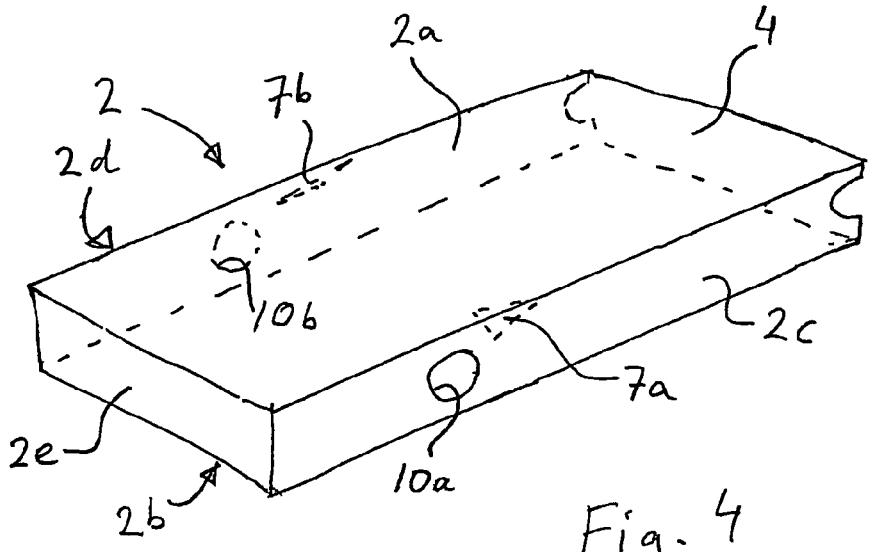
FIG. 4 shows a perspective view of a part of the package which has been manufactured from the manufacturing blank in FIG. 3, certain concealed parts being marked by broken lines.

FIG. 4 shows the folded-together and glued sleeve with certain concealed parts marked by broken lines. The first stop tab 7*a* and the second stop tab 7*b* are located on the inside of the sleeve, in respective corners formed by the upper wall 2*a*, and the first side wall 2*c* and the second side wall 2*d*, respectively. The first stop tab 7*a* and the second stop tab 7*b* are also located at a distance from a rear wall 2*e* of the sleeve 2.

Figure 5:
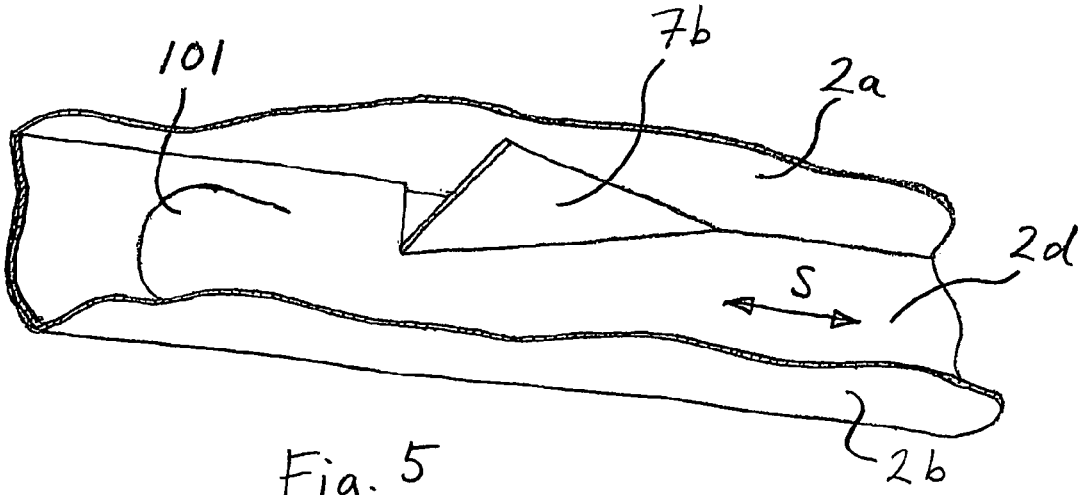
FIG. 5 shows in perspective a cut-out part of the part in FIG. 4.

FIG. 5 shows, for the sake of clarity, a part of the sleeve 2 cut out, in perspective at an angle from below. The second stop tab 7*b* extends from the inside of the second side wall 2*d* to the inside of the upper wall 2*a*. The stop tab 7*b* therefore extends at an angle to the walls 2*a*, 2*d* of the sleeve so that at least a part of it is located in a part of the area for the movement of the insert 3 in the sliding direction S. As described in greater detail below, the stop tab 7*b* acts by contact with the insert 3 in order to prevent the latter from being drawn out of the sleeve 2. The fact that the stop tab 7*b* extends inside the walls of the sleeve and is separated from these ensures that its functioning is not sensitive to wear of the same after repeated use. Furthermore, a solution is achieved, in which the stop tab is separated from the sleeve walls without a means, such as a projecting part, intended especially for the purpose being required.

As can be seen in FIG. 5, the stop tab 7*b* is also angled in relation to the sliding direction S of the insert 3, so that that part of the stop tab located closest to the opening 4 of the sleeve is located closer to the sleeve walls 2*a*, 2*d* than the other parts of the stop tab. By virtue of this, when the insert is inserted into the sleeve, parts of the insert 3 intended for locking, which are described in greater detail below, can, by elastic deformation on contact with the stop tab 7*b*, pass the latter and "snap" back after passing. This design of the stop tab 7*b* also means that it is very strong and can withstand great forces when attempts are made to draw it out without an unlocking manoeuvre as described below.

Figure 6:
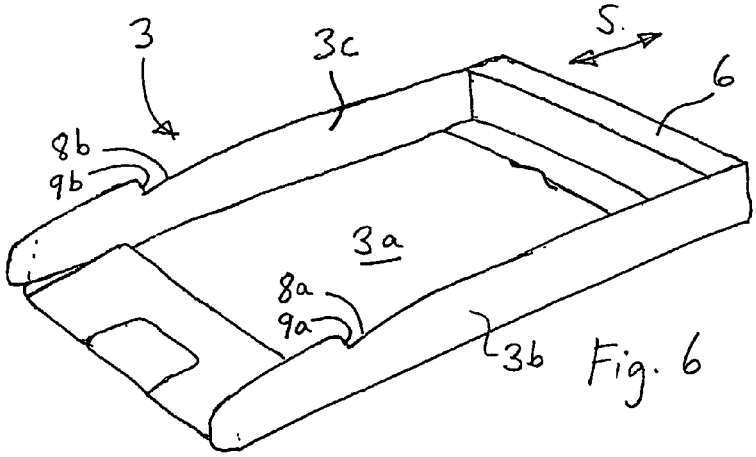
FIG. 6 shows a perspective view of a part of the package in FIG. 1.
Figure 7:
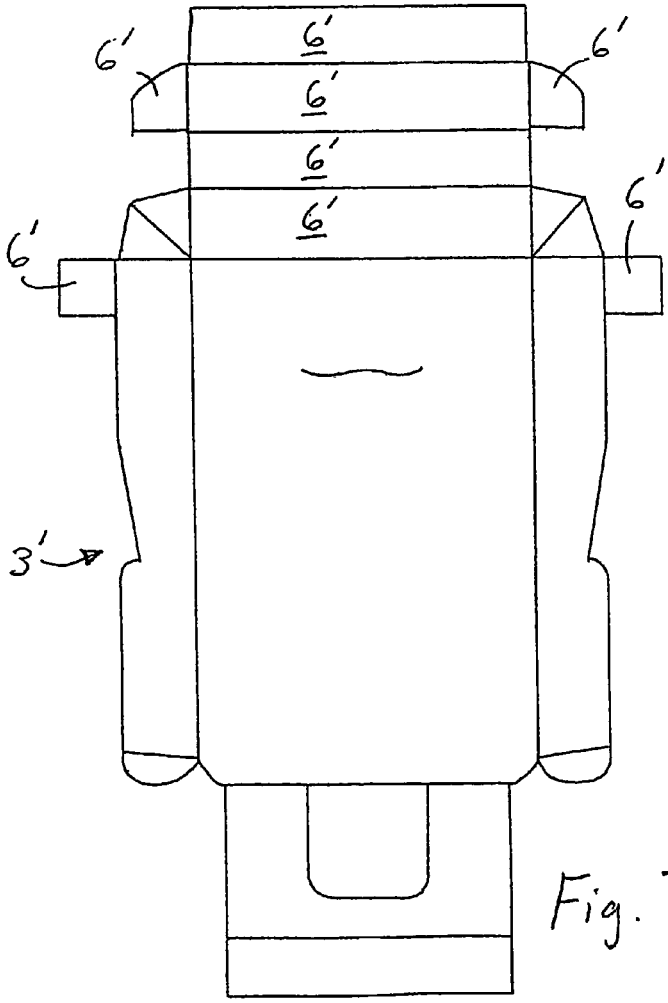
FIG. 7 shows a manufacturing blank for the part in FIG. 6.

FIG. 6 shows the insert 3, and FIG. 7 shows a blank 3' for manufacturing an insert by means of folding and if appropriate gluing. The insert blank comprises portions 6' for making the beam 6 mentioned above.

The insert 3 comprises a bottom part 3*a*, a first side part 3*b* and a second side part 3*c*. In the inserted state of the insert, the side parts 3*b*, 3*c* are located essentially parallel to and next to the side walls 2*c*, 2*d* of the sleeve 2. The side parts 3*b*, 3*c* extend essentially in the sliding direction S, intended for the insert, in the sleeve 2. They are connected to the bottom part 3*a* and are oriented essentially at right angles thereto.

Each side part 3*b*, 3*c* has a notch 8*a*, 8*b*. At the notches, a first locking edge 9*a* and a second locking edge 9*b* are formed, respectively. In the inserted state of the insert, the locking edges 9*a*, 9*b* are located slightly closer to the rear wall 2*e* of the sleeve than the stop tabs 7*a*, 7*b*, and, if attempts are made to draw the insert out of the sleeve, this is prevented by virtue of the side parts 3*b*, 3*c* coming into contact, in the area of the locking edges 9*a*, 9*b*, with the first stop tab 7*a* and the second stop tab 7*b*, respectively.

As can be seen in FIG. 3, the sleeve blank 2' has holes 10*a'*, 10*b'*, referred to as outer holes 10*a'*, 10*b'* below, on the third portion 2*c'* and the fifth portion 2*d'*, and holes 10*a"*, 10*b"*, referred to as inner holes 10*a"*, 10*b"* below, on the fourth portion 2*c"* and the sixth portion 2*d"*. The inner holes 10*a"*, 10*b"* are each covered by a flap 101 which, at an essentially straight edge of the respective inner hole, is connected to the sleeve blank so that the flap is pivotable about the straight edge.

In the finished state of the sleeve 3, the first side wall 2*c* and the second side wall 2*d* comprise parts of the third and the fourth portion 2*c'*, 2*c"*, and the fifth and the sixth portion 2*d'*, 2*d"*, respectively. In this regard, the third portion 2*c'* and the fifth portion 2*d'* are located outside the fourth portion 2*c"* and the sixth portion 2*d"*, respectively. The flaps 101 and the outer holes 10*a'*, 10*b'* are adapted in terms of size so that the flaps 101 extend outside the area of the respective outer hole 10*a'*, 10*b'* so that they are pivotable only inwards in the package. The flaps are then prevented from being moved outside the package and in this way being damaged.

Figure 8:
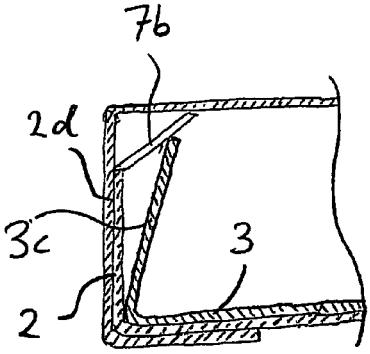
FIG. 8 shows a transverse section of a part of the package in FIGS. 1 and 2.

As can be seen in FIGS. 1, 2 and 4, the inner holes 10*a"*, 10*b"* and the outer holes 10*a'*, 10*b'* form, in the finished folded sleeve 2, a first hole 10a and a second hole 10*b* in the first side wall 2*c* and the second side wall 2*d*, respectively. The package is adapted so that a user can grip across the package with a thumb/forefinger grip. The user can then press a finger on each of the holes 10*a*, 10*b* in order to move the flaps 101 inwards and, on the inside of the sleeve, to press the side parts 3*b*, 3*c* of the insert so that these, at least in the area of the locking edges, are deformed elastically so that they are inclined inwards in the sleeve 2, which can be seen in FIG. 8 (where only one side part 3*c* is shown). The locking edges 9*a*, 9*b* are then moved away from the side walls 2*c*, 2*d* of the sleeve. In this way, the locking edges 9*a*, 9*b* come to lie, seen in the sliding direction S of the insert 3, outside the area of the extent of the stop tabs 7*a*, 7*b*, and the insert can, by means of a thumb/forefinger grip at the gripping notches 5 (described above with reference to FIGS. 1 and 2) with the other hand of the user, be drawn out of the sleeve.

In an alternative embodiment, the outer holes can each be covered by a cover which is connected to the side wall by a perforation. It is then possible, when the cover has been completely or partly removed, to see that the package is broken or that an attempt has been made to gain access to its contents.

In another alternative embodiment, the package can be designed without flaps at the holes for manoeuvring the parts for locking arranged on the insert.

The width of the package is preferably adapted so that people with small hands, for example children, cannot reach across the package with thumb and forefinger in order to manoeuvre the locking by the locking edges 9*a,* 9*b.* Opening of the package therefore requires the use of two hands of the size of those of a normal adult.

The design of parts intended for locking in longitudinal side parts of the insert results in a strong construction with a lot of material behind the locking edge, and thus reduced risk of the insert being drawn out by force, for example by a child. As an alternative, however, use can also be made of special locking tabs which are folded up from the bottom part 3*a* of the insert 3 or another part of the insert and, by contact with the stop tabs 7*a,* 7*b,* prevent the insert being drawn out of the sleeve 2.

A package with two locking arrangements each including its own locking edge and stop tab has been described above. Alternatively, a package can be provided with only one locking edge and one stop tab.

Figure 9:
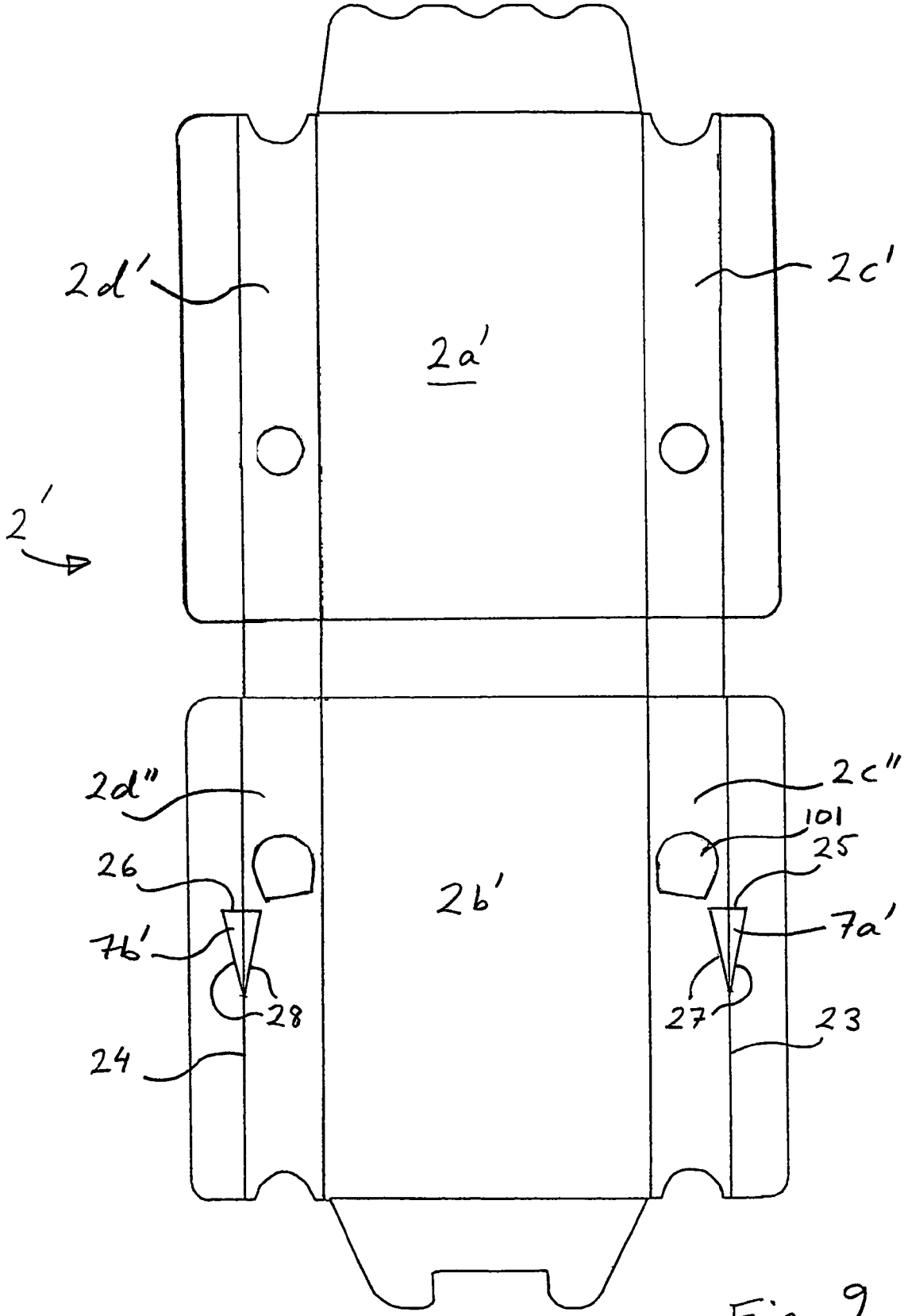
FIG. 9 shows a manufacturing blank for a part of a package according to an alternative embodiment of the invention.

FIG. 9 shows a sleeve blank 2' for a sleeve for a package according to an alternative embodiment of the present invention. The sleeve blank 2' comprises a first portion 2*a*' intended to form the upper wall 2*a* of the sleeve (cf. FIG. 4) and a second portion 2*b*' intended to form the lower wall 2*b* of the sleeve. A third portion 2*c*' and a fourth portion 2*c*" are intended to form the first side wall 2*c* of the sleeve, the fourth portion 2*c*" being intended to be positioned inside the third portion 2*c*'. In a corresponding way, a fifth portion 2*d*' and a sixth portion 2*d*" are intended to form the second side wall 2*d* of the sleeve.

A seventh portion 7*a*' and an eighth portion 7*b*' are intended to form a first stop tab 7*a* and a second stop tab 7*b,* respectively, which act to bring about locking of the insert 3 in the sleeve 2, which is described in greater detail below. As can be seen in FIG. 3, the portions 7*a*', 7*b*' which are to form stop tabs have an essentially triangular shape, one of the points of the triangle being located on a respective line 23, 24, around which the fourth portion 2*c*" and the sixth portion 2*d*", respectively, are intended to be folded. At each of the seventh portion 7*a*' and the eighth portion 7*b*', the sleeve blank 2' is provided with a through-cut 25, 26. When the fourth portion 2*c*" and the sixth portion 2*d*" are folded, the seventh portion 7*a*' and the eighth portion 7*b*' are folded around lines 27, 28 in the opposite direction so that, when the sleeve is folded together and glued, respective stop tabs are formed, which consist of two planes located at the connection of the upper wall to the respective side walls.

Figure 10:
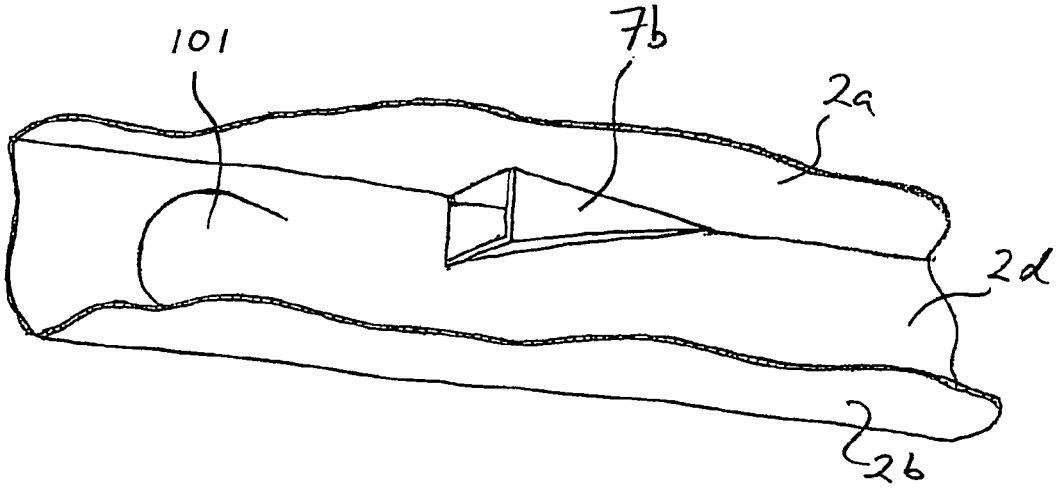
FIG. 10 shows in perspective a cut-out part of a package part which has been manufactured from the manufacturing blank in FIG. 9.
Figure 11:
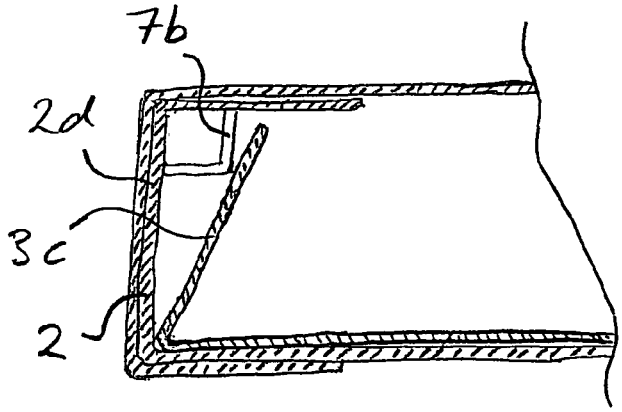
FIG. 11 shows a transverse section of a part of a package which comprises a package part which has been manufactured from the manufacturing blank in FIG. 9.

FIG. 10 shows a cut-out part of the finished sleeve 2 and one 7*b* of the stop tabs according to the alternative embodiment of the invention. FIG. 11 shows how, owing to finger pressure by a user, the side parts 3*b,* 3*c* of the sleeve (FIG. 11 shows only the second side part 3*c*) are, at least in the area of the locking edges, deformed elastically so that they are inclined inwards in the sleeve 2. This results in the locking edges 9*a,* 9*b* being moved away from the side walls 2*c,* 2*d* of the sleeve. In this way, the locking edges 9*a,* 9*b* come to lie, seen in the sliding direction S of the insert 3, outside the area of the extent of the stop tabs 7*a,* 7*b,* and the insert can, by means of a thumb/forefinger grip at the gripping notches 5 (described above with reference to FIGS. 1 and 2) with the other hand of the user, be drawn out of the sleeve.

In a special embodiment, the stop tabs extend from the side walls of the sleeve to the lower wall. The parts located on the insert for locking the insert in the sleeve are then arranged on the lower part of the insert, for example in the form of locking edges on a free edge of the insert, close to the lower wall of the sleeve.

The invention claimed is:

1. A package comprising a sleeve of essentially parallelepipedal shape, and an insert which can be inserted into and withdrawn from the sleeve in a sliding direction (S) through an opening in the sleeve, the sleeve comprising four longitudinal walls which are essentially parallel to the sliding direction (S), said longitudinal walls of the sleeve comprising an upper wall, a lower wall, a first side wall and a second side wall, wherein the sleeve is provided with a first stop tab which extends from the first side wall to the upper wall of the sleeve, the tab being at least partly separated from the first side wall and the upper wall, in that the insert has a first locking edge, the insert being prevented, upon contact of the first locking edge with the first stop tab, from moving out of the sleeve, and in that the first locking edge can, by elastic deformation of a part of the insert by means of maneuvering by a user, be moved so that its movement past the first stop tab is made possible, wherein the insert is made by folding a flat stamped blank, which includes a portion intended to act as a locking edge, and wherein the sleeve is made by folding a flat stamped blank which includes a portion intended to form the first stop tab, such that when the blank is folded into a sleeve, the first stop tab depends from and is folded in from the side wall at an angle to the side wall and bearing against the upper wall, or, in the alternative, the first stop tab depends from both the first side wall and the upper wall and is folded in from both the first side wall and the upper wall.

2. A package according to claim 1, wherein the longitudinal walls of the sleeve comprise an upper wall, a lower wall, a first side wall and a second side wall, in that the insert comprises a bottom part and a first side part, which, in the inserted state of the insert, are located essentially parallel to and next to the lower wall and the first side wall, respectively, of the sleeve, the first locking edge being formed on the first side part, in that the first longitudinal wall and the second longitudinal wall between which the first stop tab extends are the first side wall and the upper wall, respectively, in that the first side wall is provided with a first hole, through which said maneuvering can take place, the elastic deformation taking place at least partly in the first side part so that at least a part thereof moves away from the first side wall.

3. A package according to claim 2, wherein the sleeve is manufactured from a cardboard blank, in that the first side wall comprises at least parts of two cardboard portions of the cardboard blank, one cardboard portion, in the side wall, being located inside the other cardboard portion, in that the first hole is formed by an inner hole in the inner cardboard portion and an outer hole in the outer cardboard portion, and in that a pivotable flap is arranged on the inner cardboard portion, the flap in a closed position, in the plane of the first side wall, extending at least partly outside the area of extent of the outer hole.

4. A package according to claim 2, wherein the sleeve is provided with a second stop tab which extends from the second side wall to the upper wall, the tab being at least partly separated from the second side wall and the upper wall, in that a second locking edge is formed on a second side part of the insert, which second side part is, in the inserted state of the insert, located essentially parallel to and next to the second side wall of the sleeve, the insert being prevented, upon contact of the second locking edge with the second stop tab, from moving out of the sleeve, in that the second locking edge can be moved so that its movement past the second stop tab is made possible, which movement takes place by, through a second hole in the second side wall, maneuvering the second side part, so that at least a part thereof moves away from the second side wall.

5. A package according to claim 3, wherein the sleeve is provided with a second stop tab which extends from the second side wall to the upper wall, the tab being at least partly separated from the second side wall and the upper wall, in that a second locking edge is formed on a second side part of the insert, which second side part is, in the inserted state of the insert, located essentially parallel to and next to the second side wall of the sleeve, the insert being prevented, upon contact of the second locking edge with the second stop tab, from moving out of the sleeve, in that the second locking edge can be moved so that its movement past the second stop tab is made possible, which movement takes place by; through a second hole in the second side wall, maneuvering the second side part, so that at least a part thereof moves away from the second side wall.

* * * * *